US008478157B2

(12) United States Patent
Furukawa

(10) Patent No.: US 8,478,157 B2
(45) Date of Patent: Jul. 2, 2013

(54) IMAGE FORMING DEVICE THAT EXECUTES REVERSE-TRANSFER OPERATION

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 151 days.

(21) Appl. No.: 12/855,315

(22) Filed: Aug. 12, 2010

(65) Prior Publication Data

US 2011/0158666 A1 Jun. 30, 2011

(30) Foreign Application Priority Data

Dec. 25, 2009 (JP) ..... 2009-294148

(51) Int. Cl.
*G03G 15/16* (2006.01)
*G03G 21/00* (2006.01)

(52) U.S. Cl.
USPC ..... 399/101; 399/357

(58) Field of Classification Search
USPC ..... 399/101, 357, 358
See application file for complete search history.

(56) References Cited

U.S. PATENT DOCUMENTS

| | | | | |
|---|---|---|---|---|
| 5,740,493 | A * | 4/1998 | Otaki et al. | 399/71 |
| 7,274,889 | B2 * | 9/2007 | Furukawa | 399/71 |
| 2008/0031649 | A1 | 2/2008 | Dan | |
| 2008/0317506 | A1 | 12/2008 | Furukawa | |
| 2010/0061744 | A1 | 3/2010 | Kim | |

FOREIGN PATENT DOCUMENTS

| | | |
|---|---|---|
| JP | 2001-5360 | 1/2001 |
| JP | 2003-280335 | 10/2003 |
| JP | 2005-338205 | 12/2005 |
| JP | 2007-121657 | 5/2007 |
| JP | 2008-39905 | 2/2008 |
| JP | 2009-3377 | 1/2009 |

OTHER PUBLICATIONS

U.S. Office Action dated Feb. 19, 2013, received in related U.S. Appl. No. 12/855,337.
Office Action dated Jan. 22, 2013 received from the Japanese Patent Office from related Japanese Application No. 2009-294148, together with an English-language translation.
Office Action dated Jan. 22, 2013 received from the Japanese Patent Office from related Japanese Application No. 2009-294147 and U.S. Appl. No. 12/855,337, together with an English-language translation.

* cited by examiner

*Primary Examiner* — David Gray
*Assistant Examiner* — Gregory H Curran
(74) *Attorney, Agent, or Firm* — Scully, Scott, Murphy & Presser, PC

(57) ABSTRACT

An image forming device in a continuous mode forms monochrome images on a plurality of recording media in succession. A transfer member is disposed in confrontation with a plurality of photosensitive members. In the continuous mode, a control unit controls a reverse-transfer unit to perform a reverse-transfer operation on at least one of a plurality of collecting members such that the excrescences are transferred from the at least one of the photosensitive members onto the transfer member in a medium interval. A switching unit sets a contact state to a first contact state during the reverse-transfer operation in the continuous mode such that one of the developing rollers for black contacts one of the photosensitive members for black and that remaining ones of the developing rollers are separated from remaining ones of the photosensitive members.

22 Claims, 7 Drawing Sheets

CONTACT STATE OF DEVELOPING ROLLER

BIAS APPLIED TO COLLECTING MEMBER

BIAS APPLIED TO COLLECTING MEMBER

IMAGE FORMING DEVICE THAT EXECUTES REVERSE-TRANSFER OPERATION

CROSS REFERENCE TO RELATED APPLICATION

This application claims priority from Japanese Patent Application No. 2009-294148 filed Dec. 25, 2009. The entire content of this priority application is incorporated herein by reference.

TECHNICAL FIELD

The present invention relates to an image forming device, such as a color laser printer.

BACKGROUND

There has been provided a laser printer for forming color images. For example, a laser printer employing a direct-transfer method includes a plurality of photosensitive members for respective colors, and a developing unit having a plurality of developing rollers for forming toner images with toner of each color corresponding to respective electrostatic latent images on the photosensitive members. The toner images are transferred from the photosensitive members onto a printing sheet of paper conveyed on a conveying belt to form a color image.

Some type of laser printer has a color mode for forming color images and a monochrome mode for forming monochrome images only with black toner. In the monochrome mode, only a developing roller for black is placed in contact with a corresponding photosensitive member, and remaining developing rollers are kept out of contact with corresponding photosensitive members. In the color mode, on the other hand, all of the developing rollers are in contact with the corresponding photosensitive members.

Some of the toner constituting the toner image on each photosensitive member may not be transferred onto a printing sheet and remains on the photosensitive member. Also, toner of opposite polarity clinging on the conveying belt may be transferred onto the photosensitive member when transfer operation is performed. In order to remove such toner (residue toner) and other excrescences from the photosensitive member, a collecting roller may be provided for each photosensitive member.

Specifically, a predetermined bias is applied to each collecting roller to transfer the excrescences from the photosensitive member onto the collecting roller. Then, the excrescences collected onto the collecting roller are transferred back onto the photosensitive member and further onto the conveying belt. This operation is referred to as "reverse-transfer operation" hereinafter. Thereafter, the excrescences are removed from the conveying belt with a cleaning member disposed in contact with the conveying belt.

SUMMARY

In the laser printer described above, an amount of excrescences needed to be removed from the photosensitive members increases as image forming operations are performed in succession. In the color mode, the developing rollers maintained in contact with the photosensitive members collect some of the excrescences from the photosensitive members, so the collecting rollers can collect the remaining excrescences sufficiently. In the monochrome mode, however, the developing rollers corresponding to colors other than black are separated from the photosensitive members and thus do not collect any excrescences. Accordingly, the amount of excrescences that each of these collecting rollers needs to collect is larger than that the collecting roller for black needs to collect. As a result, an excessive amount of excrescences may accumulate on these collecting rollers and degrade collecting capability thereof. In this case, the excrescences remain on the photosensitive members and adversely affect image quality.

In order to overcome this problem, it is conceivable to perform the reverse-transfer operation once each time the image forming operation is performed on a single printing paper when the image forming operations are performed in succession in the monochrome mode. However, in this case, the developing roller for black is separated from and then brought back to contact with the corresponding photosensitive member each time the reverse-transfer operation is performed. This undesirably reduces overall image forming speed.

In view of the foregoing, it is an object of the invention to provide an image forming device capable of performing a reverse-transfer operation when image forming operations are performed in succession while preventing lowering of image forming speed.

In order to attain the above and other objects, the invention provides an image forming device that performs an image forming operation in one of a color mode for forming a color image with developers of a plurality of colors including black, a monochrome mode for forming a monochrome image with black developer, and a continuous mode for forming in succession a plurality of monochrome images on a plurality of recording media including a first recording medium and a second recording medium following the first recording medium. The image forming device includes a plurality of photosensitive members for the respective colors, a plurality of developing rollers for the respective colors, a transfer member disposed in confrontation with the plurality of photosensitive members, a plurality of collecting members for the respective colors, a reverse-transfer unit, a control unit, and a switching unit. Each of the developing rollers is configured to supply the developer to the corresponding photosensitive member to form a developer image on the photosensitive member. The transfer member is configured to transfer the developer images from the photosensitive members onto a recording medium. Each of the collecting members is configured to collect excrescences that remain on the corresponding photosensitive member after the developer image is transferred onto the recording medium. The reverse-transfer unit performs a reverse-transfer operation on at least one of the collecting members so as to transfer the excrescences collected by the at least one of the collecting members back onto at least one of the photosensitive members and further onto the transfer member. The control unit controls the reverse-transfer unit to perform the reverse-transfer operation in the continuous mode such that the excrescences are transferred from the at least one of the photosensitive members onto the transfer member in a medium interval, which is a timing between when the first recording medium is past a first confronting position between the photosensitive member and the transfer member and when the second recording medium reaches the first confronting position. The switching unit sets a contact state to a first contact state during the reverse-transfer operation in the continuous mode such that one of the developing rollers for black contacts one of the photosensitive members for black and that remaining ones of the developing rollers are separated from remaining ones of the photosensitive members.

The invention also provides an image forming device that performs an image forming operation in one of a color mode for forming a color image with developers of a plurality of colors including black, a monochrome mode for forming a monochrome image with black developer, and a continuous mode for forming in succession a plurality of monochrome images on a plurality of recording media including a first recording medium and a second recording medium following the first recording medium. The image forming device includes a plurality of photosensitive members for the respective colors, a plurality of developing rollers for the respective colors, an intermediate transfer member disposed in confrontation with the plurality of photosensitive members, a transfer member disposed in confrontation with the intermediate transfer member, a plurality of collecting members for the respective colors, a reverse-transfer unit, a control unit, and a switching unit. Each developing roller is configured to supply the developer to the corresponding photosensitive member to form a developer image on the photosensitive member. The developer images formed on the photosensitive members are transferred onto the intermediate transfer member. The transfer member is configured to transfer the developer images from the intermediate transfer member onto a recording medium located between the transfer member and the intermediate transfer member. Each collecting member is configured to collect excrescences that remain on the corresponding photosensitive member after the developer image is transferred onto the intermediate transfer member. The reverse-transfer unit performs a reverse-transfer operation on at least one of the collecting members so as to transfer the excrescences collected by the at least one of the collecting members back onto at least one of the photosensitive members and further onto the intermediate transfer member. The control unit controls the reverse-transfer unit to perform the reverse-transfer operation in the continuous mode such that the excrescences are transferred from the at least one of the photosensitive members onto the intermediate transfer member in a medium interval, which is a timing between when first developer images to be transferred onto the first recording medium are transferred onto the intermediate transfer member and when second developer images to be transferred onto the second recording medium are transferred onto the intermediate transfer member. The switching unit sets a contact state to a predetermined contact state during the reverse-transfer operation in the continuous mode such that one of the developing rollers for black contacts one of the photosensitive members for black and that remaining ones of the developing rollers are separated from remaining ones of the photosensitive members.

BRIEF DESCRIPTION OF THE DRAWINGS

The particular features and advantages of the invention as well as other objects will become apparent from the following description taken in connection with the accompanying drawings, in which:

FIG. 4(*b*) is a timing chart of biases applied to the collecting members according to the first embodiment of the invention;

DETAILED DESCRIPTION

Figure 1:
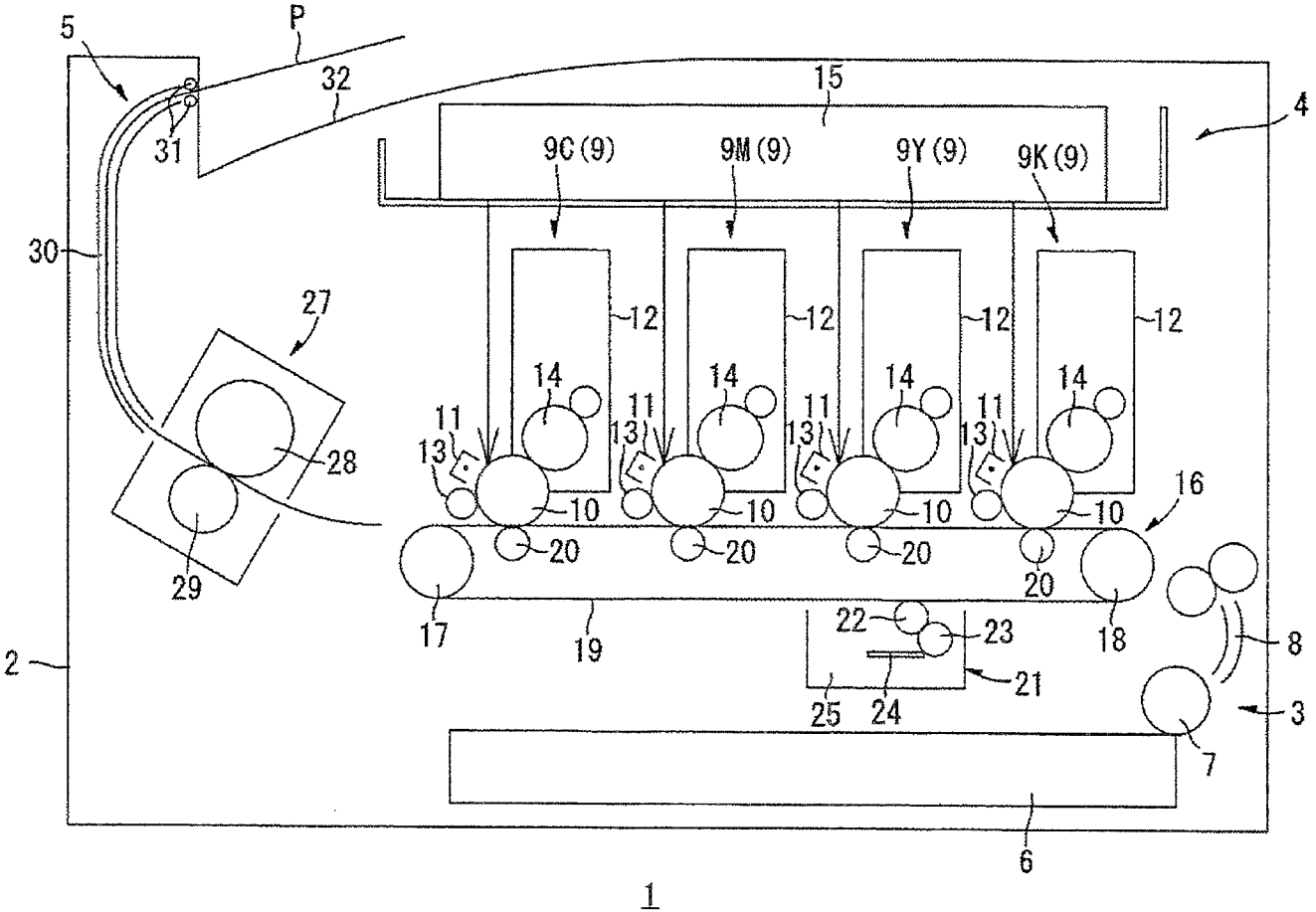
FIG. 1 is a cross-sectional side view showing the overall configuration of a color laser printer according to a first embodiment of the invention.

Image forming devices according to embodiments of the invention will be described while referring to the accompanying drawings wherein like parts and components are designated by the same reference numerals to avoid duplicating description. Note that the terms "upper," "lower," "beneath," and the like will be used throughout the description assuming that an image forming device is disposed in an orientation in which it is intended to be used. In use, the image forming device is disposed as shown in FIG. 1.

FIG. 1 shows a color laser printer 1 as an image forming device according to a first embodiment of the invention. The color laser printer 1 is a tandem-type color laser printer, and includes a box-shaped main casing 2 and, within the main casing 2, a sheet supply unit 3 for supplying a sheet P, an image forming unit 4 for forming images on the sheet P supplied from the sheet supply unit 3, and a discharge unit 5 for discharging the sheet P with images formed thereon.

The sheet supply unit 3 includes a supply tray 6 for storing a stack of sheets P and a feed roller 7 for feeding the sheets P stacked on the supply tray 6 one at a time. The sheet P fed by the feed roller 7 is conveyed along a sheet conveying path 8 toward the image forming unit 4.

The image forming unit 4 includes four process units 9, i.e., a black process unit 9K, a yellow process unit 9Y, a magenta process unit 9M, and a cyan process unit 9C arranged in this order in a sheet conveying direction of the sheet P.

Each process unit 9 includes a photosensitive drum 10 (photosensitive member), a charging unit 11, a developing unit 12, and a collecting member 13.

The photosensitive drum 10 is in a column shape and driven to rotate in a predetermined direction (a clockwise direction in FIG. 1) during an image forming operation. The charging unit 11 is a positive Scorotron charging unit, for example.

The charging unit 11 includes a wire and a grid, and generates corona discharge when a charging bias is applied thereto.

The developing unit 12 is disposed on the downstream side of the charging unit 11 in the rotation direction of the photosensitive drum 10. The developing unit 12 accommodates toner (developer) of each color, and has a developing roller 14 for supplying the toner to the surface of the photosensitive drum 10. The developing roller 14 is disposed to extend along a center axis of the photosensitive drum 10 and to contact the surface of the photosensitive drum 10 with the peripheral surface thereof. During the image forming operation, a developing bias is applied to the developing roller 14.

The collecting member 13 is disposed on the upstream side of the charging unit 11 and downstream side of a conveying belt 19 (described later) in the rotation direction of the photosensitive drum 10. The collecting member 13 is disposed to extend along the center axis of the photosensitive drum 10 and to contact the surface of the photosensitive drum 10 with the peripheral surface thereof. A collecting bias is selectively applied to the collecting member 13 in a manner described later.

During the image forming operation (developing operation), the photosensitive drum 10 is driven to rotate in the predetermined direction. The corona discharge generated by the charging unit 11 uniformly charges the surface of the rotating photosensitive drum 10 with positive polarity. Then, the positively charged surface of the photosensitive drum 10 is exposed to high speed scanning of a laser beam emitted from an exposure unit 15. As a result, an electrostatic latent image corresponding to an image to be printed on the sheet P is formed on the surface of the photosensitive drum 10. Subsequently, the toner carried on the developing roller 14 is selectively supplied to the electrostatic latent image on the photosensitive drum 10. As a result, the electrostatic latent image is transformed into a visible toner image. In this manner, the toner image is formed on the photosensitive drum 10.

Note that the exposure unit 15 is configured of LED array. The exposure unit 15 may be provided to each process unit 9. Alternatively, the exposure unit 15 may be disposed above the image forming unit 4 as a scanner unit having a light source and a polygon mirror.

The color laser printer 1 also includes a transfer unit 16 disposed beneath the four process units 9 for transferring the toner images from the photosensitive drums 10 to the sheet P.

The transfer unit 16 (transfer member) includes a drive roller 17, a driven roller 18 disposed opposing with the drive roller 17 at a position upstream of the drive roller 17 in the sheet conveying direction, and the conveying belt 19 wound around and stretched between the drive roller 17 and the driven roller 18. The conveying belt 19 is an endless belt.

The transfer unit 16 is disposed such that a top surface of an upper portion of the conveying belt 19 running between the top of the drive roller 17 and the top of the driven roller 18 contacts with the surfaces of the photosensitive drums 10. The drive roller 17 is driven by a driving force from a motor (not shown) to rotate in a direction (counterclockwise direction in FIG. 1) opposite to the rotation direction of the photosensitive drum 10. Rotation of the drive roller 17 circulates the conveying belt 19 in the same direction as the drive roller 17, which in turn rotates the driven roller 18.

The transfer unit 16 also includes four transfer rollers 20 and a cleaning unit 21. The transfer rollers 20 are disposed in confrontation with the corresponding photosensitive drums 10 with an upper portion of the conveying belt 19 interposed therebetween. The cleaning unit 21 is disposed in opposition to a lower part of the conveying belt 19.

The sheet P conveyed from the sheet supply unit 3 to the image forming unit 4 is supplied onto the conveying belt 19 and conveyed by the circulation of the conveying belt 19 to sequentially pass through nip points between the conveying belt 19 and the photosensitive drums 10 for the respective colors in the order of black, yellow, magenta, and cyan. At this time, a transfer bias applied to each transfer roller 20 transfers the toner image formed on each photosensitive drum 10 onto the sheet P. Any residual toner remaining on the photosensitive drums 10 after this transfer operation is electrostatically transferred onto the collecting members 13 when the residual toner comes into opposition to the collecting members 13. Thus transferred toner is accumulated on the collecting members 13 by electrostatic adsorption.

The cleaning unit 21 includes a primary cleaning roller 22, a secondary cleaning roller 23, an urethane blade 24, and a storage 25.

The primary cleaning roller 22 is disposed to extend horizontally in a direction orthogonal to the circulation direction of the conveying belt 19 and to contact the bottom surface of the lower part of the conveying belt 19 with the peripheral surface thereof. The primary cleaning roller 22 is driven to rotate in the same direction (counterclockwise direction in FIG. 1) as the circulation direction of the conveying belt 19. The secondary cleaning roller 23 is disposed to extend parallel to the primary cleaning roller 22 and contacts the peripheral surface of the primary cleaning roller 22.

The primary cleaning roller 22 and the secondary cleaning roller 23 are both applied with the cleaning biases to generate potential differences between the conveying belt 19 and the primary cleaning roller 22 and between the primary cleaning roller 22 and the secondary cleaning roller 23. The potential difference between the conveying belt 19 and the primary cleaning roller 22 transfers excrescences from the surface of the conveying belt 19 to the primary cleaning roller 22, and the potential difference between the primary cleaning roller 22 and the secondary cleaning roller 23 transfers the excrescences from the primary cleaning roller 22 to the secondary cleaning roller 23. Subsequently, the urethane blade 24 scrapes the excrescences from the secondary cleaning roller 23, and the excrescences are eventually collected into the storage 25.

The image forming unit 4 further includes a fixing unit 27 for fixing the toner images onto the sheet P. The fixing unit 27 includes a heat roller 28 and a pressure roller 29. When the sheet P passes through between the heat roller 28 and the pressure roller 29, the toner images transferred onto the sheet P are fixed onto the sheet P by heat and pressure. The sheet P discharged from the fixing unit 27 is then conveyed along a sheet conveying path 30 and discharged by discharge rollers 31 onto a discharge tray 32 formed on top of the main casing 2.

Figure 2:
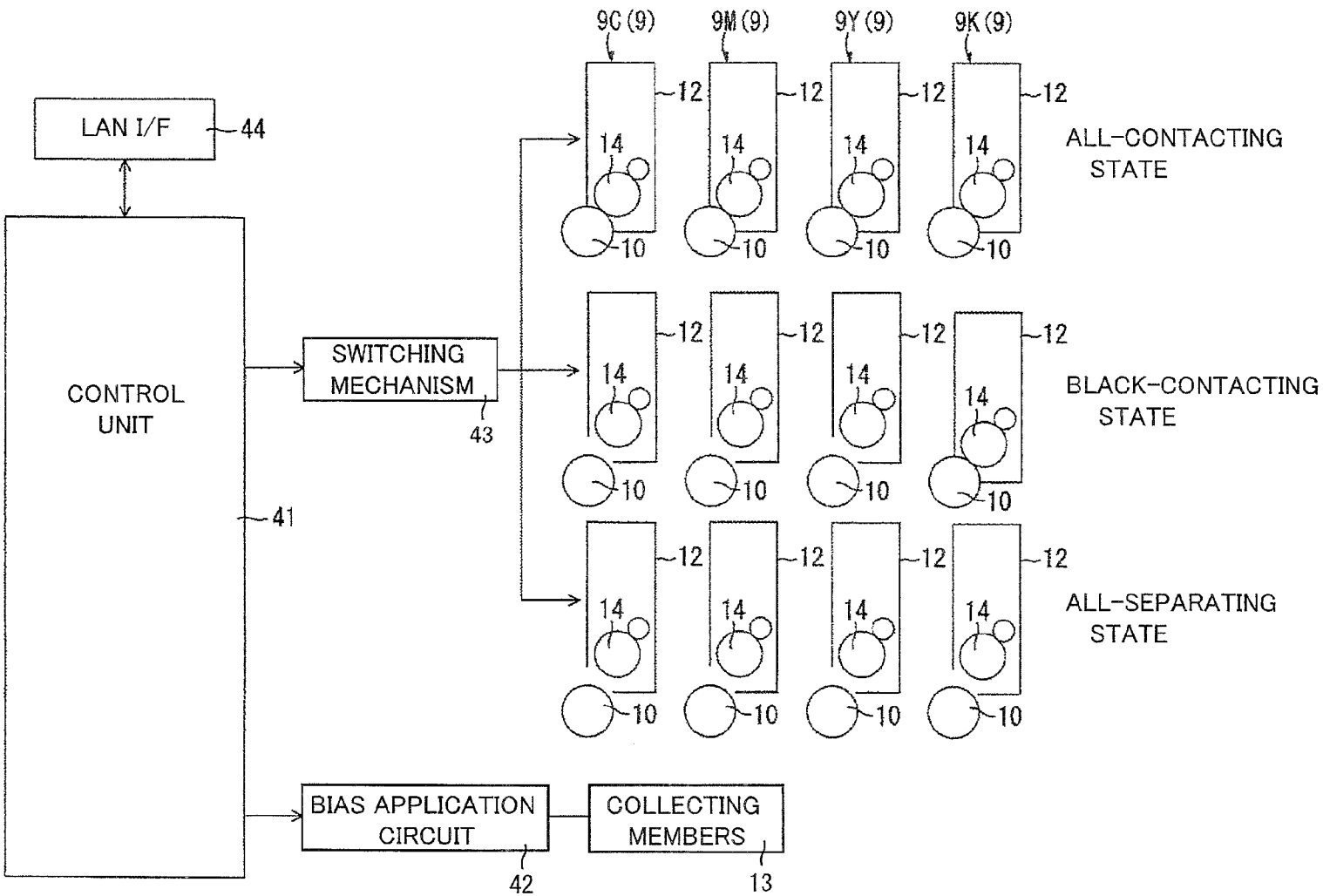
FIG. 2 is a block diagram showing relevant parts of the color laser printer according to the first embodiment of the invention.

As shown in FIG. 2, the color laser printer 1 further includes a control unit 41, a bias application circuit 42, and a switching mechanism 43. The control unit 41 is a microcomputer including a CPU, a RAM, and a ROM (not shown). Both the bias application circuit 42 and the switching mechanism 43 are connected to the control unit 41 as controlled objects of the control unit 41.

The bias application circuit 42 (reverse-transfer unit) is for selectively applying the collecting bias and a repelling bias of polarity opposite to the polarity of the collecting bias to each collecting member 13. Under the control of the control unit 41, the bias application circuit 42 can apply the collecting bias or the repelling bias in the range between −500 V to +500 V to each collecting member 13.

More specifically, during the image forming operation, the control unit 41 controls the bias application circuit 42 to apply enough collecting bias to transfer excrescences, such as toner and the like, from the photosensitive drum 10 to the collecting member 13, and to apply the repelling bias to each collecting member 13 at a timing and frequency described later. The repelling bias applied to each collecting member 13 transfers the excrescences from the surface of the collecting member 13 back onto the corresponding photosensitive drum 10.

The excrescences transferred back onto the photosensitive drum 10 are brought into confrontation with the conveying belt 19 by the rotation of the photosensitive drum 10, transferred onto the conveying belt 19, and then collected by the primary cleaning roller 22 as described above. A process to transfer the excrescences back onto the photosensitive drum 10 and further to the conveying belt 19 as described above will be hereinafter referred to as a reverse-transfer operation. Note that the bias application circuit 42 also applies the transfer bias to each of the transfer roller 20.

In this embodiment, each developing unit 12 is positioned so as to be movable relative to the corresponding photosensitive drum 10.

The switching mechanism 43 is for setting a contact state of the developing rollers 14 with respect to the photosensitive drums 10 in a method well-known in the art. More specifically, under the control of the control unit 41, the switching mechanism 43 sets the contact state to one of an all-separating state, a black-contacting state, and an all-contacting state. In the all-separating state, all of the four developing rollers 14 are out of contact with the corresponding photosensitive drums 10. In the black-contacting state, only the developing roller 14 for black is in contact with the photosensitive drum 10 of the black process unit 9K, and the remaining three developing rollers 14 are out of contact with the corresponding photosensitive drums 10. In the all-contacting state, all of the four developing rollers 14 are in contact with the corresponding photosensitive drums 10.

The control unit 41 controls the switching mechanism 43 to set the contact state to the black-contacting state when images are to be formed only with black toner, and to the all-contacting state when images are to be formed with toner of all colors.

The color laser printer 1 also includes a local area network interface (LAN I/F) 44 connected to the control unit 41 for connection to a LAN. The control unit 41 receives print data (image data) and the like from a personal computer connected to the LAN, for example, through the LAN I/F 44, and controls each of the above-mentioned components to form either color images or monochrome images on the sheet P based on the print data.

Figure 3:
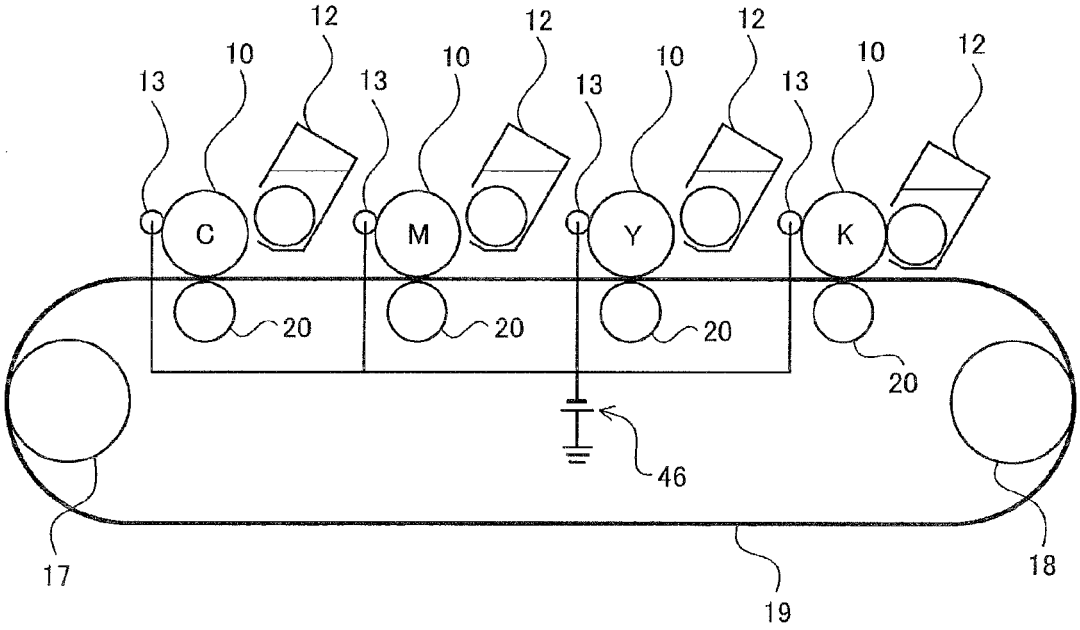
FIG. 3 is an illustrative side view showing a power source connected to collecting members of the color laser printer according to the first embodiment of the invention.

The bias application circuit 42 includes a power source 46 shown in FIG. 3 that is connected to all of the collecting members 13 such that the collecting members 13 are applied with either the collecting biases or the repelling biases at the same timing.

Next, the reverse-transfer operation performed when the image forming operations are performed on a plurality of sheet P in succession will be described with reference to timing charts of FIGS. 4(*a*) and 4(*b*). The color laser printer 1 has a color mode for forming a color image by superimposing a plurality of toner images of different colors and a monochrome mode for forming a monochrome image only with black toner. The color laser printer 1 also has a continuous mode, which is for forming a plurality of monochrome images on a plurality of sheets P in succession in the monochrome mode. In the following explanation, it is assumed that the color laser printer 1 is in the continuous mode.

Figure 4A:
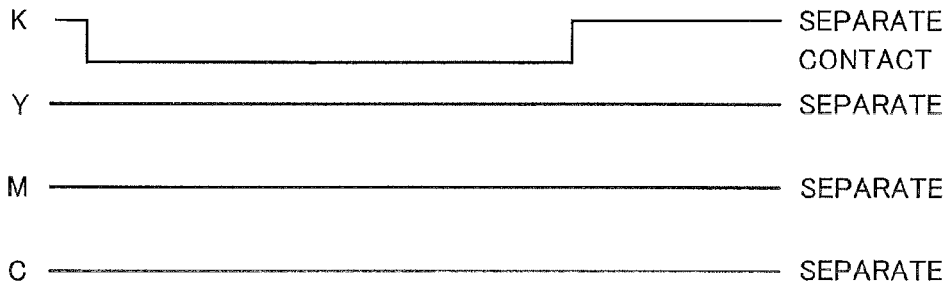
FIG. 4(*a*) is a timing chart of contact states of developing rollers to photosensitive members according to the first embodiment of the invention.
Figure 4B:
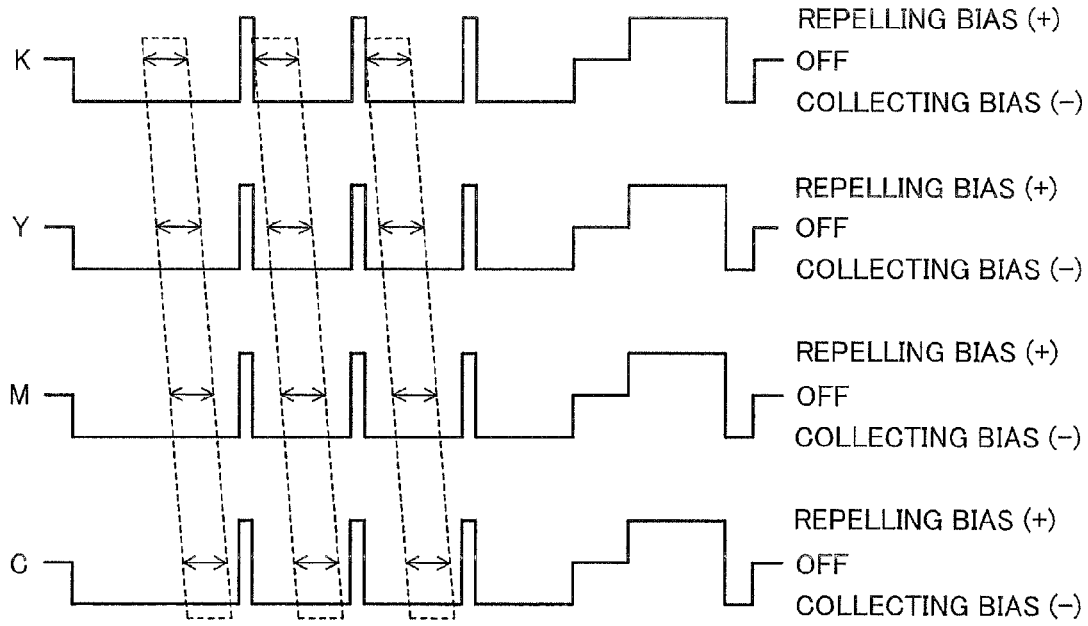

As shown in FIG. 4(*a*), before forming an image on a first sheet P, the switching mechanism 43 sets the contact state to the black contact state, where only the developing roller 14 of the black process unit 9K is in contact with the photosensitive drum 10, and the developing rollers 14 of the yellow, magenta, and cyan process units 9Y, 9M, and 9C are out of contact with the photosensitive drums 10. Also, as shown in FIG. 4(*b*), the bias application circuit 42 applies the collecting biases to all of the collecting members 13.

Note that regions encircled by dotted-chain lines in FIG. 4(*b*) indicate time regions when the collecting members 13 confront image forming regions of the photosensitive drums 10 where toner images are to be formed. Thus, the collecting biases need to be applied to the collecting members 13 at least in the encircled time regions.

Then, a black toner image is formed on the photosensitive drum 10 of the black process unit 9K located most upstream side in the sheet conveying direction with the developing roller 14, and is transferred onto the sheet P at the nip point between the conveying belt 19 and the photosensitive drum 10 of the black process unit 9K. Thereafter, the sheet P is conveyed so as to pass through the nip points on the downstream side in the order of yellow, magenta, and cyan.

At this point, residue toner that has not been transferred onto the sheet P remains on the surface of the photosensitive drum 10 of the black process unit 9K that past the nip point. Also, some of the toner constituting the black toner image on the sheet P transfers onto the surface of the photosensitive drum 10 of the yellow, magenta, or cyan process unit 9Y, 9M, or 9C at the corresponding nip point on the downstream side of the black process unit 9K. The residue toner and the toner transferred onto the photosensitive drums 10 from the sheet P will be collectively referred to as "excrescences" hereinafter.

When the photosensitive drum 10 completes one rotation after the time region encircled by the dotted line, the excrescences on the photosensitive drum 10 come into confrontation with the corresponding collecting member 13 applied with the collecting bias. As a result, the excrescences are transferred onto the collecting member 13.

Thereafter, the repelling bias is applied to the collecting member 13, so that the excrescences on the collecting member 13 are transferred back onto the photosensitive drum 10. As described above, the repelling biases are applied to all of the collecting members 13 at the same timing by the common power source 46. The excrescences transferred back onto the photosensitive drum 10 are further transferred onto the conveying belt 19 and collected by the cleaning unit 21. This reverse-transfer operation is performed until a next sheet P reaches the image forming unit 4.

In other words, the reverse-transfer operation is performed in a sheet interval (medium interval). More specifically, the reverse-transfer operation is performed a timing between when a tailing edge of an image forming region on the photosensitive drum 10 of the cyan process unit 9C where a toner image for the first sheet P is to be formed is past a position where the photosensitive drum 10 of the cyan process unit 9C confronts the corresponding collecting member 13 and when a reading edge of an image forming region on the photosensitive drum 10 of the black process unit 9K where a toner image for the second sheet P is to be formed reaches a position where the photosensitive drum 10 of the black process unit 9K confronts the collecting member 13. This configuration ensures that the excrescences are transferred from each photosensitive drum 10 onto the conveying belt 19 at a timing between when the first sheet P is past a confronting position between the photosensitive drum 10 and the conveying belt 19 and when the second sheet P reaches the confronting position.

Because the repelling bias is only applied to the collecting member 13 when the collecting member 13 confronts a region other than the image forming region on the photosensitive drum 10, it is possible to prevent the excrescences from being transferred back onto the image forming region on the photosensitive drum 10.

In the similar manner, the reverse-transfer operation is performed each time the image forming operation is performed on the second sheet P or a third sheet P. After the image forming operations are performed in succession, the contact state is switched to the all-separating state as shown in FIG. 4(*a*), and the repelling biases are again applied to the collecting members 13 as shown in FIG. 4(*b*) to transfer the excrescences onto the photosensitive drums 10, and the excrescences are transferred onto the conveying belt 19 and then collected into the cleaning unit 21.

As shown in FIG. 4(*a*), the black-contact state is maintained even during the reverse-transfer operations. Thus, some of the excrescences transferred back onto the photosensitive drum 10 by the repelling bias is transferred onto the surface of the developing roller 14 of the black process unit 9K when brought into confrontation with the developing roller 14, and is eventually collected into the black process unit 9K. Because the black process unit 9K is located on the most upstream side in the sheet conveying direction, most of the excrescences on the photosensitive drum 10 of the black process unit 9K is black toner. Thus, even if some of the excrescences is collected into the black process unit 9K in the above-described manner, it is highly unlikely that toner other than black (i.e., yellow toner, magenta toner, and cyan toner) is collected into the black process unit 9K.

As described above, according to the present embodiment, the reverse-transfer operation is performed in the sheet interval in the continuous mode (i.e., during the successive image forming operations in the monochrome mode.) Thus, it is possible to prevent a large amount of excrescences from accumulating on the collecting member 13. This prevents degradation in collecting capability of the collecting member 13.

Also, the black-contacting state is maintained even when the reverse-transfer operation is performed as described above. This configuration eliminates the necessity of switching the contact state of the developing roller 14 before and after the reverse-transfer operation. Thus, it is possible to perform the reverse-transfer operation while preventing lowering of image forming speed.

Also, because the power source 46 applies the repelling biases to all of the collecting members 13, the repelling biases can be applied to the collecting members 13 with a simple configuration.

Next, a color laser printer 100 according to a second embodiment of the invention will be described with reference to FIGS. 5 and 6.

Figure 5:
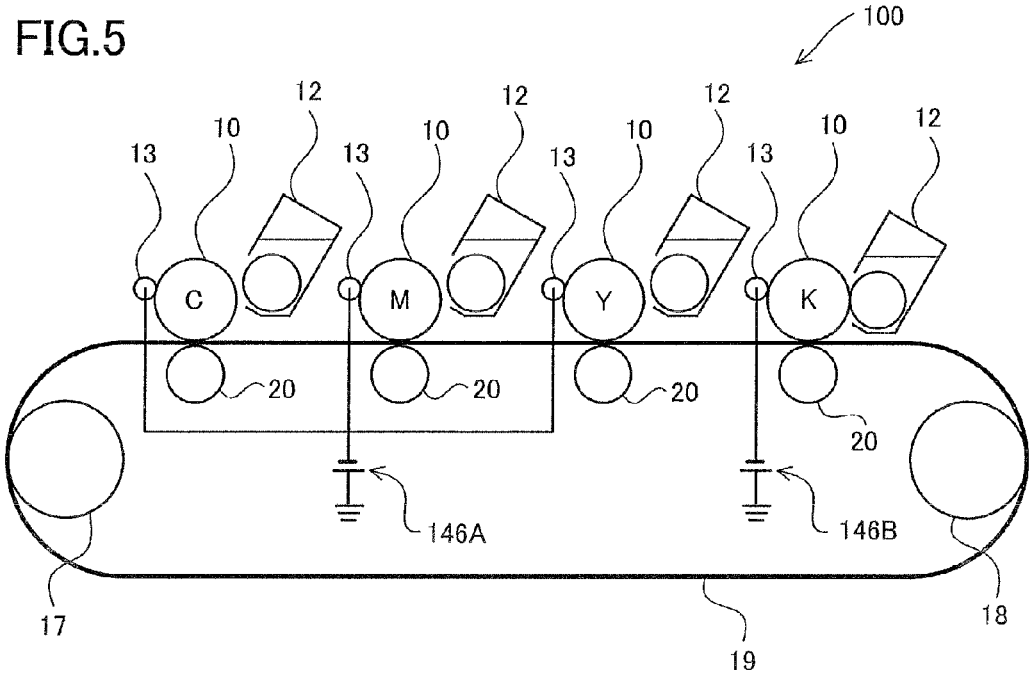
FIG. 5 is an illustrative side view showing power sources connected to collecting members of a color laser printer according to a second embodiment of the invention.

As shown in FIG. 5, in the color laser printer 100 of the second embodiment, the collecting member 13 of the black process unit 9K is connected to a power source 146A, and the collecting members 13 of the yellow, magenta, and cyan process units 9Y, 9M, and 9C are connected to a power source 146B.

Figure 6:
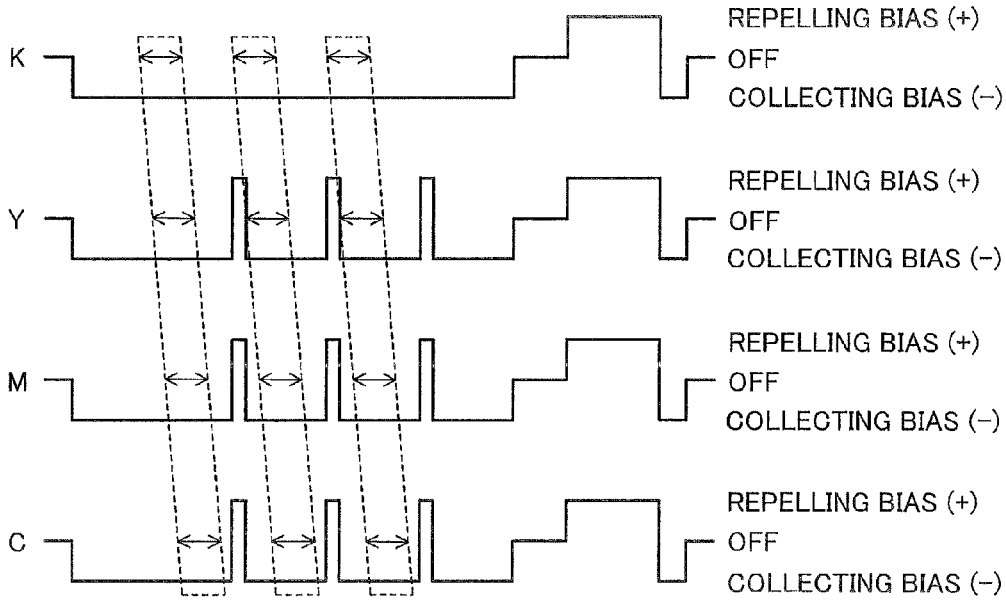
FIG. 6 is a timing chart of biases applied to the collecting members according to the second embodiment of the invention.

As shown in FIG. 6, when successive image forming operations are started, first all of the collecting members 13 are applied with the collecting biases to collect excrescences from the photosensitive drums 10.

After excrescences are collected from the image forming region of the photosensitive drum 10 of the cyan process unit 9C located most downstream in the paper conveying direction, the power source 146B applies the repelling biases to the collecting members 13 for yellow, magenta, and cyan. As a result, the excrescences are transferred from the collecting members 13 onto the photosensitive drums 10 of the yellow, magenta, and cyan process units 9Y, 9M, and 9C. This reverse-transfer operation is ended immediately before an image forming region on the photosensitive drum 10 of the yellow process unit 9Y where a toner image for a second sheet P reaches a position where the photosensitive drum 10 of the yellow process unit 9Y confronts the corresponding collecting member 13.

However, the power source 146A keeps applying the collecting bias to the collecting member 13 of the black process unit 9K even while the power source 146B applies the repelling biases. Thus, the collecting member 13 of the black process unit 9K keeps collecting excrescences from the photosensitive drum 10 of the black process unit 9K. The excrescences collected by the collecting member 13 of the black process unit 9K are transferred back onto the photosensitive drum 10 after the successive image forming operations are completed.

According to the present embodiment, because the reverse-transfer operation is performed for the process units 9 other than the black process unit 9K, it is possible to prevent degradation in collecting capabilities of the collecting members 13 of these process units 9. Although the reverse-transfer operation is not performed for the black process unit 9K during the successive image forming operations, excrescences on the photosensitive drum 10 of the black process unit 9K hardly affect image quality because the developing roller 14 in contact with the photosensitive drum 10 can collect some of the excrescences from the photosensitive drum 10. That is, the collecting member 13 of the black process unit 9K hardly degrades in its collecting capability even if the reverse-transfer operation is not performed during the successive image forming operations.

Also, because the reverse-transfer operation is not performed for the black process unit 9K during the successive image forming operations, the sheet interval can be shortened to increase the image forming speed. This makes it possible to prevent lowering of the overall image forming speed. Also, because the collecting members 13 for the yellow, magenta, and cyan process units 9Y, 9M, and 9C are applied with the repelling biases from the common power source 149B, it is possible to simplify the configuration to apply the repelling biases to the collecting members 13 of the yellow, magenta, and cyan process units 9Y, 9M, and 9C.

Figure 7:
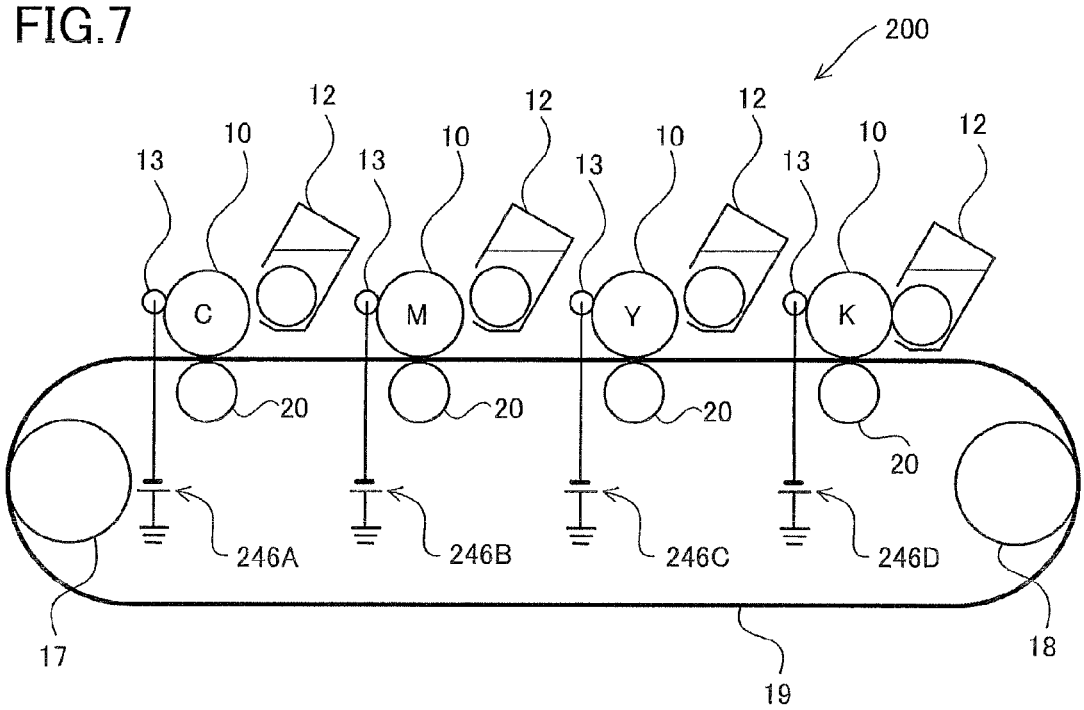
FIG. 7 is an illustrative side view showing power sources connected to collecting members of a color laser printer according to a third embodiment of the invention.

Next, a color laser printer 200 according to a third embodiment of the invention will be described with reference to FIGS. 7 and 8. In this embodiment, the collecting members 13 are connected to respective power sources 246A, 246B, 246C, and 246D. Thus, the reverse-transfer operation can be performed at a different timing for each of the yellow, magenta, and cyan process units 9Y, 9M, and 9C, in this order.

Figure 8:
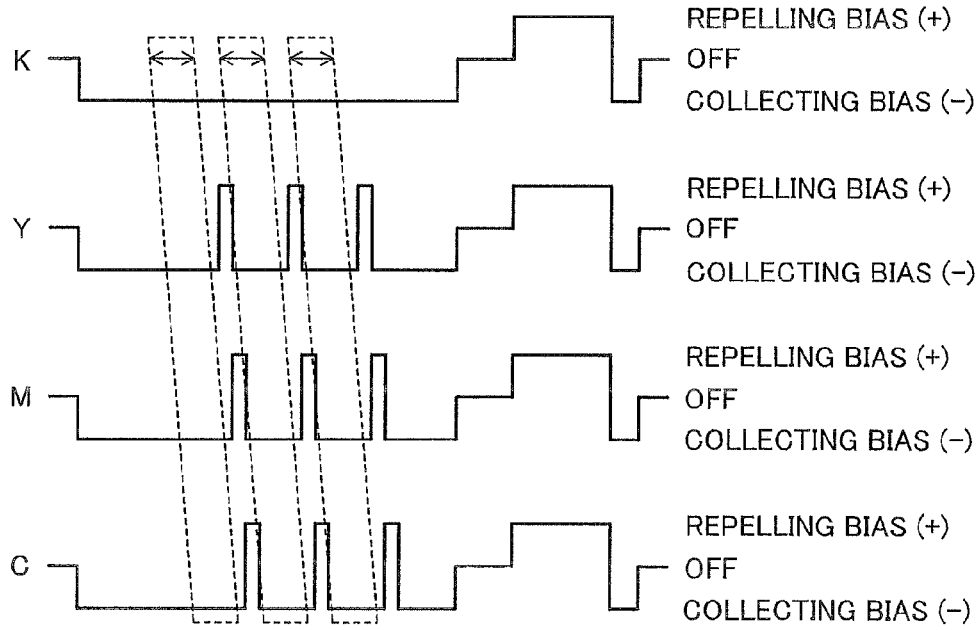
FIG. 8 is a timing chart of biases applied to the collecting members according to the third embodiment of the invention.

Specifically, as shown in FIG. 8, the power source 246A constantly applies the collecting bias to the collecting members 13 of the black process unit 9K when the image forming operations are performed in succession in the monochrome mode. On the other hand, the power sources 246B, 246C, and 246D apply either the collecting bias or the repelling bias at different timing in accordance with the sheet interval and the like such that the reverse-transfer operation is performed immediately after excrescences are collected from the image forming region of the corresponding photosensitive drum 10. This configuration makes it possible to further shorten the sheet interval, and thus to further prevent lowering of image forming speed of the successive image forming operations.

While the invention has been described in detail with reference to the embodiments thereof, it would be apparent to those skilled in the art that various changes and modifications may be made therein without departing from the spirit of the invention.

For example, the control unit 41 may control the switching mechanism 43 to set the contact state to the all-separating state when the reverse-transfer operation is performed in the color mode.

With this configuration, the excrescences transferred from the collecting members 13 back onto the photosensitive drums 10 do not cling onto the developing rollers 14 because the developing rollers 14 are kept out of contact with the photosensitive drums 10. Although there is a possibility that excrescences collected onto the collecting member 13 corresponding to a particular color include toner of different color, this configuration prevents such toner of different color from clinging onto the developing roller 14 corresponding to the particular color and from adversely affecting image quality.

Figure 9:
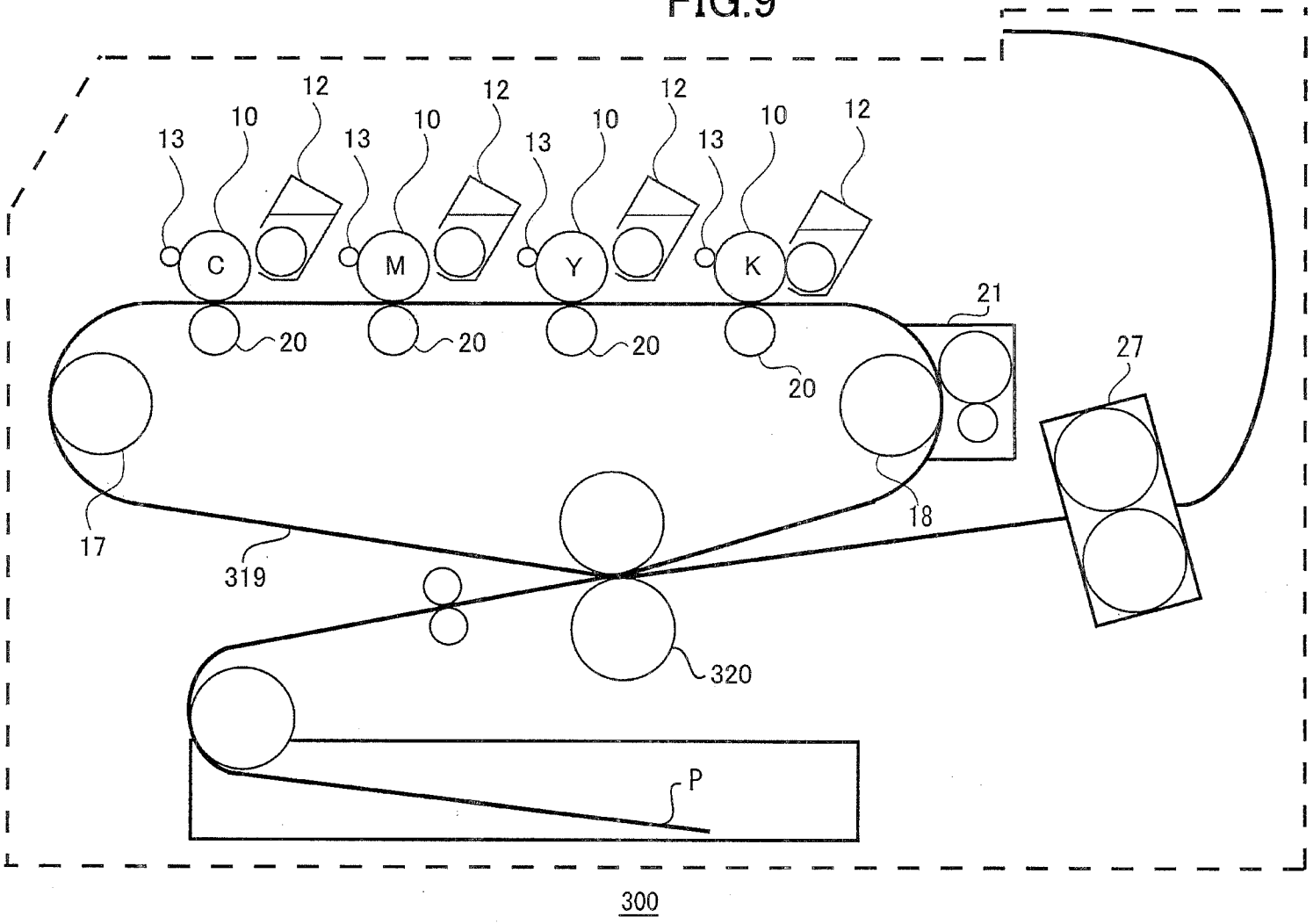
FIG. 9 is an illustrative side view according to a modification of the first to third embodiments of the invention.

Also, the present invention may also be applied to a color laser printer including an intermediate transfer member. More specifically, a color laser printer 300 shown in FIG. 9 includes an intermediate transfer belt 319. The toner images formed on the respective photosensitive drums 10 are once transferred onto the intermediate transfer belt 319, and then transferred onto the sheet P by a transfer roller 320 when the sheet P passes between a nip point between the intermediate transfer belt 319 and the transfer roller 320. In this configuration, the reverse-transfer operation is performed such that the excrescences transferred back onto the photosensitive drums 10 are transferred onto the intermediate transfer belt 319 in a sheet interval, i.e., between when toner images to be transferred onto a sheet P are transferred from the photosensitive drums 10 onto the intermediate transfer belt 319 and when next toner images to be transferred onto a next sheet P are transferred from the photosensitive drums 10 onto the intermediate transfer belt 319.

What is claimed is:

1. An image forming device that performs an image forming operation in one of a color mode for forming a color image with developers of a plurality of colors including black, a monochrome mode for forming a monochrome image with black developer, and a continuous mode for forming in succession a plurality of monochrome images on a plurality of recording media comprising:

a plurality of photosensitive members for the respective colors;

a plurality of developing rollers for the respective colors, each configured to supply the developer to the corresponding photosensitive member to form a developer image on the photosensitive member;

a transfer member disposed in confrontation with the plurality of photosensitive members, the transfer member being configured to transfer the developer images from the photosensitive members onto a recording medium;

a plurality of collecting members for the respective colors, each configured to collect excrescences that remain on the corresponding photosensitive member after the developer image is transferred onto the recording medium;

a reverse-transfer unit configured to perform a reverse-transfer operation on at least one of the collecting members so as to transfer the excrescences collected by the at least one of the collecting members back onto at least one of the photosensitive members and further onto the transfer member;

a control device configured to control the reverse-transfer unit and the at least one of the collecting members, in the continuous mode the control device controlling the reverse-transfer unit to perform, every time an image formation for one recording medium is completed, the reverse-transfer operation such that the excrescences are transferred from the at least one of the photosensitive members onto the transfer member at a timing in a medium interval, the medium interval being an interval between when a preceding recording medium is past a first confronting position between the photosensitive member and the transfer member and when a subsequent recording medium reaches the first confronting position, the subsequent recording medium following the preceding recording medium; and a switching unit that sets a contact state to a first contact state during the reverse-transfer operation in the continuous mode such that one of the developing rollers for black contacts one of the photosensitive members for black and that remaining ones of the developing rollers are separated from remaining ones of the photosensitive members.

2. The image forming device according to claim 1, wherein the control device controls the reverse-transfer unit to perform the reverse-transfer operation at a timing between when a first image forming region on the one of the photosensitive members for black where a first developer image for the preceding recording medium is to be formed is past a second confronting position between the one of the photosensitive members for black and the corresponding collecting member and when a second image forming region on the one of the photosensitive members for black where a second developer image for the subsequent recording medium is to be formed reaches the second confronting position.

3. The image forming device according to claim 1, wherein the control device controls the reverse-transfer unit to perform the reverse-transfer operation on the collecting members for the colors other than black in the continuous mode.

4. The image forming device according to claim 1, wherein the control device controls the reverse-transfer unit to perform the reverse-transfer operation on each of the at least one of the collecting members at a different timing.

5. The image forming device according to claim 4, wherein the plurality of colors further include yellow, magenta, and cyan, and the control device controls the reverse-transfer unit to perform the reverse-transfer operation on three of the collecting members for yellow, magenta, and cyan in the order of yellow, magenta, and cyan.

6. The image forming device according to claim 1, further includes a first power source configured to supply power voltages to one of the collecting members for black and a second power source configured to supply power voltage to remaining ones of the collecting members for the colors other than black.

7. The image forming device according to claim 1, further includes a power source configured to supply power voltages to all of the collecting members.

8. The image forming device according to claim 1, wherein the switching unit sets the contact state to a second contact state in the color mode such that all of the developing rollers are separated from the corresponding photosensitive members when the reverse-transfer unit performs the reverse-transfer operation.

9. The image forming device according to claim 1, wherein the plurality of photosensitive members includes a first photosensitive member and a second photosensitive member, and the control device controls the reverse-transfer unit to perform the reverse-transfer operation at a timing between when a third image forming region on the first photosensitive member where a third developer image for the preceding recording medium is to be formed passes through a first position where the first photosensitive member confronts the corresponding collecting member and when a fourth image forming region on the second photosensitive member where a fourth developer image for the subsequent recording medium is to be formed reaches a second position where the second photosensitive member confronts the corresponding collecting member.

10. An image forming device that performs an image forming operation in one of a color mode for forming a color image with developers of a plurality of colors including black, a monochrome mode for forming a monochrome image with black developer, and a continuous mode for forming in succession a plurality of monochrome images on a plurality of recording media comprising:

a plurality of photosensitive members for the respective colors;

a plurality of developing rollers for the respective colors, each configured to supply the developer to the corresponding photosensitive member to form a developer image on the photosensitive member;

an intermediate transfer member disposed in confrontation with the plurality of photosensitive members, wherein the developer images formed on the photosensitive members are transferred onto the intermediate transfer member;

a transfer member disposed in confrontation with the intermediate transfer member, the transfer member being configured to transfer the developer images from the intermediate transfer member onto a recording medium located between the transfer member and the intermediate transfer member;

a plurality of collecting members for the respective colors, each configured to collect excrescences that remain on the corresponding photosensitive member after the developer image is transferred onto the intermediate transfer member;

a reverse-transfer unit configured to perform a reverse-transfer operation on at least one of the collecting members so as to transfer the excrescences collected by the at least one of the collecting members back onto at least one of the photosensitive members and further onto the intermediate transfer member;

a control device configured to control the reverse-transfer unit and the at least one of the collecting members, in the continuous mode, the control device controlling the reverse-transfer unit to perform, every time an image formation for one recording medium is completed, the reverse-transfer operation such that the excrescences are transferred from the at least one of the photosensitive members onto the intermediate transfer member at a timing in a medium interval, the medium interval being an interval between when first developer images to be transferred onto a preceding recording medium are transferred onto the intermediate transfer member and when second developer images to be transferred onto a subsequent recording medium are transferred onto the intermediate transfer member, the subsequent recording medium following the preceding recording medium; and a switching unit that sets a contact state to a predetermined contact state during the reverse-transfer operation in the continuous mode such that one of the developing rollers for black contacts one of the photosensitive members for black and that remaining ones of the developing rollers are separated from remaining ones of the photosensitive members.

11. An image forming device comprising:

an image forming unit including:

a first photosensitive member on which a monochrome developer image is formed with a black developer;

a second photosensitive member on which a color developer image is formed with a color developer;

a first developing roller configured to supply the black developer to the first photosensitive member to form the monochrome developer image on the first photosensitive member;

a second developing roller configured to supply the color developer to the second photosensitive member to form the color developer image on the second photosensitive member;

a transfer member disposed in confrontation with the first photosensitive member and the second photosensitive member, the transfer member being configured to transfer, onto a recording medium, the black developer image and color developer image from the first photosensitive member and the second photosensitive member, respectively;

a first collecting member configured to collect excrescences that remain on the first photosensitive member after the black developer image is transferred onto the recording medium; and a second collecting member configured to collect excrescences that remain on the second photosensitive member after the color developer image is transferred onto the recording medium;

a switching unit configured to move the first developing roller and the second developing roller between a first position and a second position, wherein in the first position, the first developing roller contacts the first photosensitive member and the second developing roller contacts the second photosensitive member, and in the second position, the first developing roller contacts the first photosensitive member and the second developing roller is separated from the second photosensitive member;

a conveying member configured to convey a plurality of recording media to the image forming unit subsequently;

a control device configured to control the conveying unit and the image forming unit to perform, every time the image forming unit completes an image formation for one recording medium when the switching unit sets the second position, a first transfer operation so as to transfer the excrescences collected by the second collecting member back onto the second photosensitive member and further onto the transfer member at a timing in a medium interval, the medium interval being an interval between when a preceding recording medium is past a predetermined position and when a subsequent recording medium reaches the predetermined position, the subsequent recording medium following the preceding recording medium.

12. The image forming device according to claim 11, wherein the control device is configured to control the conveying unit and the image forming unit to perform, every time the image forming unit completes an image formation for one recording medium when the switching unit sets the second position, a second transfer operation so as to transfer the excrescences collected by the first collecting member back onto the first photosensitive member and further onto the transfer member at a timing in the medium interval.

13. The image forming device according to claim 12, wherein the first photosensitive member includes a first image forming region where a first developer image for the preceding recording medium is to be formed and a second image forming region where a second developer image for the subsequent recording medium is to be formed, wherein the medium interval is an interval between when a trailing edge of the first image forming region is past a confronting position between the first photosensitive member and the first collecting member and when a leading edge of the second image forming region reaches the confronting position.

14. The image forming device according to claim 12, wherein the control device performs the first transfer operation and the second transfer operation at a different timing.

15. The image forming device according to claim 11, further including a first power source configured to supply power voltages to the first collecting member and a second power source configured to supply power voltage to the second collecting member.

16. The image forming device according to claim 11, further including a power source configured to supply power voltages to both the first collecting member and the second collecting member.

17. An image forming device comprising:

an image forming unit including:

a first photosensitive member on which a monochrome developer image is formed with a black developer;

a second photosensitive member on which a color developer image is formed with a color developer;

a first developing roller configured to supply the black developer to the first photosensitive member to form the monochrome developer image on the first photosensitive member;

a second developing roller configured to supply the color developer to the second photosensitive member to form the color developer image on the second photosensitive member;

an intermediate transfer member disposed in confrontation with the first photosensitive member and the second photosensitive member, wherein the monochrome developer image formed on the first photosensitive member and the color developer image formed on the second photosensitive member are transferred onto the intermediate transfer member;

a transfer member disposed in confrontation with the intermediate transfer member, the transfer member being configured to transfer the first developer image and the second developer image from the intermediate transfer member onto a recording medium located between the transfer member and the intermediate transfer member;

a first collecting member configured to collect excrescences that remain on the first photosensitive member alter the black developer image is transferred onto the recording medium; and a second collecting member configured to collect excrescences that remain on the second photosensitive member after the color developer image is transferred onto the recording medium;

a switching unit configured to move the first developing roller and the second developing roller between a first position and a second position, wherein in the first position, the first developing roller contacts the first photosensitive member and the second developing roller contacts the second photosensitive member, and in the second position, the first developing roller contacts the first photosensitive member and the second developing roller is separated from the second photosensitive member;

a conveying member configured to convey a plurality of recording media to the image forming unit subsequently;

a control device configured to control the conveying unit and the image forming unit to perform, every time the image forming unit completes an image formation for one recording medium when the switching unit sets the second position, a first transfer operation so as to transfer the excrescences collected by the second collecting member back onto the second photosensitive member and further onto the intermediate transfer member at a timing in a medium interval the medium interval being an interval between when a preceding recording medium is past a predetermined position and when a subsequent recording medium reaches the predetermined position, the subsequent recording medium following the preceding recording medium.

18. The image forming device according to claim 17, wherein the control device is configured to control the conveying unit and the image forming unit to perform, every time the image forming unit completes an image formation for one recording medium when the switching unit sets the second position, a second transfer operation so as to transfer the excrescences collected by the first collecting member back onto the first photosensitive member and further onto the intermediate transfer member at a timing in the medium interval.

19. The image forming device according to claim 18, wherein the first photosensitive member includes a first image forming region where a first developer image for the preceding recording medium is to be formed and a second image forming region where a second developer image for the subsequent recording medium is to be formed, wherein the medium interval is an interval between when a trailing edge of the first image forming region is past a confronting position between the first photosensitive member and the first collecting member and when a leading edge of the second image forming region reaches the confronting position.

20. The image forming device according to claim 18, wherein the control device performs the first transfer operation and the second transfer operation at a different timing.

21. The image forming device according to claim 17, further including a first power source configured to supply power voltages to the first collecting member and a second power source configured to supply power voltage to the second collecting member.

22. The image forming device according to claim 17, further including a power source configured to supply power voltages to both the first collecting member and the second collecting member.

* * * * *